US005585601A

United States Patent [19]

Adler

[11] Patent Number: 5,585,601

[45] Date of Patent: Dec. 17, 1996

[54] WIRE CONNECTOR

[76] Inventor: Dan Adler, 2 Shderot Yerushalayim, Ashdod, Israel

[21] Appl. No.: 539,795

[22] Filed: Oct. 5, 1995

Related U.S. Application Data

[63] Continuation of Ser. No. 517,042, Aug. 21, 1995, abandoned.

[51] Int. Cl.[6] ..... H01R 4/12

[52] U.S. Cl. ..... 174/87; 174/845

[58] Field of Search ..... 174/84 R, 84 S, 174/87, 91; 439/409, 417, 441, 468, 910; 242/7.17; 140/118, 119; 315/70, 57; 336/107

[56] References Cited

U.S. PATENT DOCUMENTS

| | | | |
|---|---|---|---|
| 1,657,933 | 1/1928 | Lindsley | 174/84 S |
| 1,763,298 | 6/1930 | Franzen | 403/214 |
| 4,107,453 | 8/1978 | Erixon | 174/87 |
| 4,163,868 | 8/1979 | Stotts | 174/87 |
| 5,446,241 | 8/1995 | Mackaness | 174/91 |

*Primary Examiner*—Kristine L. Kincaid
*Assistant Examiner*—Marc Machtinger
*Attorney, Agent, or Firm*—Mark M. Friedman

[57] ABSTRACT

A wire connector including a first member and a second member defining a cavity therebetween, the first member including a first channel and a second channel, the second member including a third channel and a fourth channel, the first, second, third and fourth channels being in communication with to the cavity, forming a substantially X-shaped form, the X-shaped form including a substantially central point. The first and the third channels are substantially collinear. At least one of the first and the third channels having a first additional opening for accommodating a first wire. The second and the fourth channels are substantially collinear. At least one of the second and third channels having a second additional opening for accommodating a second wire. The winding of the wires is by rotating the first member relative to the second members substantially around the central point, thereby winding the first and the second wires of the wire pair.

20 Claims, 6 Drawing Sheets

WIRE CONNECTOR

This is a Continuation-in-Part of U.S. patent application Ser. No. 08/517,042, filed Aug. 21, 1995, now abandoned.

FIELD AND BACKGROUND OF THE INVENTION

The present invention relates to a wire connector and, more particularly, to a device permitting a secured, strong and safe winding of many wire pairs simultaneously.

Connecting wire pairs, such as, for example, electrical wire pairs, is very common. One way of connecting two electrical wires is by pressing each of the wires to a mutual metal member by screws, using a screw drive. However, screwing screws in large numbers is time consuming and tedious.

Another way of connecting two electrical wires is by winding the electrical wires around each other. Winding electrical wires is relatively an efficient way of connecting two or more electrical wires since it yields a large area of contact between the wound wires and, therefore, good conductivity (e.g. low resistance of the connecting region to electrical current) and strong physical connection between the electrical wires are obtained.

A common, yet unsafe, non-repetitive and, therefore, less efficient way of winding electrical wires being winding the wires manually. However, manually wound electrical wires tend to physically disconnect. Furthermore, such electrical wire connections are typically covered for insulation and, more importantly, for safety purposes, with izolirband, which tends to fall off.

To overcome the above mentioned disadvantages of manual electrical wire winding, devices such as the one shown in FIGS. 1*a–b*, permitting winding of two electrical wires were developed. As shown in FIG. 1*a*, these devices are generally characterized by two substantially similar hingedly attached members 10 and 12 arranged as to form a mirror image of one another. Each of members 10 and 12 has two 14*a* and 14*b* and, 16*a* and 16*b*, respectively, parallel channels suitable to accommodate an electrical wire, the channels are arranged so that channel 14*a* is in a direct linear continuation of channel 16*a* and channel 14*b* is in a direct linear continuation of channel 16*b*. At the connection between members 10 and 12, engulfing channels 14*a* and 14*b* and channels 16*a* and 16*b*, each of members 10 and 12 has a ring, 18 and 20, respectively, protecting the wound electrical wires.

The operation of the device for wire winding described above is shown in FIGS. 1*a–b* and involves (a) inserting a first electrical wire 22 through channel 16*a* onto channel 14*a*; (b) inserting a second electrical wire 24 either through channel 14*b* onto channel 16*b* (wires oriented 180° one relative to the other) or through channel 16*b* onto channel 14*b* (wires oriented 0° one relative to the other); (c) rotating member 10 relative to member 12 as to wind the wires one around the other as detailed in FIG. 2.

The device described above has two drawbacks. First this device is suitable for connecting only two electrical wires and can not be modularity changed to enable the winding of more than two electrical wires. Second, as shown in FIG. 2, the wound region is collinear with the remaining not wound parts of the wires, therefore, when pulling the wires away from one another, the vectorial force imposed on the connection substantially equals the total amount of force applied by thus pulling the wires.

There is thus a widely recognized need for, and it would be highly advantageous to have, a wire connector permitting a secured, strong and safe wire winding of any number of wires, which wire connector ensures that the axis along which winding occurs, is not collinear with the unwound remaining of the wires, or permits further strengthening the connection of collinear wound wires, or both, thereby, strengthening the connection between the wires.

SUMMARY OF THE INVENTION

According to the present invention there is provided a wire connector permitting a secured, strong and sate winding of wire pairs.

According to further features in preferred embodiments of the invention described below, the wire connector includes a first member and a second member defining a cavity therebetween, the first member including a first channel and a second channel, the second member including a third channel and a fourth channel, the first, second, third and fourth channels being in communication with the cavity, forming a substantially X-shaped form, the X-shaped form including a substantially central point. The first and the third channels being substantially collinear. At least one of the first and the third channels having a first additional opening for accommodating a first wire. The second and the fourth channels being substantially collinear. At least one of the second and fourth channels having a second additional opening for accommodating a second wire. The winding of the wires is by rotating the first member relative to the second members substantially around the central point, thereby winding the first and the second wires of the wire pair, therefore, connecting the first and the second wires.

According to still further features in the described preferred embodiments the first, second, third and fourth channels have a third additional opening.

According to still further features in the described preferred embodiments the first, second, third and fourth channels have a fourth additional opening.

According to still further features in the described preferred embodiments the wire connector further includes a hinge connecting the first and the second members substantially at the central point for rotating the first member relative to the second member substantially around the central point.

According to still further features in the described preferred embodiments the hinge is a simple hinge, the simple hinge is crossing the cavity.

According to still further features in the described preferred embodiments the hinge is a circular hinge, the circular hinge is surrounding the cavity.

According to still further features in the described preferred embodiments the first and the third channels form a first continuous channel and the second and the fourth channels form a second continuous channel, the first and second continuous channels intersect to form the cavity.

According to still further ligatures in the described preferred embodiments the first and second members are made of electrical current insulating materials.

According to still further features in the described preferred embodiments the electrical current insulating materials are selected from the group consisting of plastic, rubber, glass, wood, synthetic polymers, natural polymers and combinations thereof.

According to still further features in the described preferred embodiments the cavity is formed solely in one of the first and second members.

According to still further features in the described preferred embodiments the cavity is formed in the first and the second members.

According to still further features in the described preferred embodiments each of the members includes at least one additional channel for accommodating one additional wire, the at least one additional channel communicating with the cavity, the wire connector enabling winding of the one additional wire with the first and second wires.

According to another embodiment, the wire connector comprising a housing and a compatible pin defining a cavity therebetween, the housing including a first channel and a second channel, the pin including a third channel and a fourth channel, the first, second, third and fourth channels being in communication with the cavity, the first and the third channels being substantially collinear, at least one of the first and the third channels having a first additional opening for accommodating the first wire, and, the second and the fourth channels being substantially collinear, at least one of the second and third channels having a second additional opening for accommodating the second wire.

According to still further features in the described preferred embodiments the channels of the housing and of the pin form a substantially X-shaped form.

According to still further features in the described preferred embodiments the channels of the housing and of the pin are in a parallel arrangement.

According to still further features in the described preferred embodiments the pin is threaded and the housing is compatibly threaded.

According to still further features in the described preferred embodiments each of the housing and pin includes at least one additional channel for accommodating one additional wire, the at least one additional channel communicating with the cavity, the wire connector enabling winding of the one additional wire with the first and second wires.

The present invention successfully addresses the shortcomings of the presently known configurations by providing a wire connector permitting a secured, strong and safe winding of many wire pairs simultaneously, the wires of any wire pair connected by the wire connector of the present invention are arranged in an angle one relative to the other forming an X-shape, otherwise, namely when parallel, strengthened by a pin, or both, therefore, the windings are more resistant to a pull in any given vectorial direction.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a wire connector which can be used to connect one or more wire pairs simultaneously. Specifically, the present invention can be used to connect any number of wire pairs in a secured strong and safe way by winding together wires belonging to the pairs.

It should be noted that the term 'wire' as used herein and in the claims also refer to any kind of cable, rope, filament, chain, string and the like.

The principles and operation of a wire connector according to the present invention may be better understood with reference to the drawings and the accompanying description.

Figure 3A:
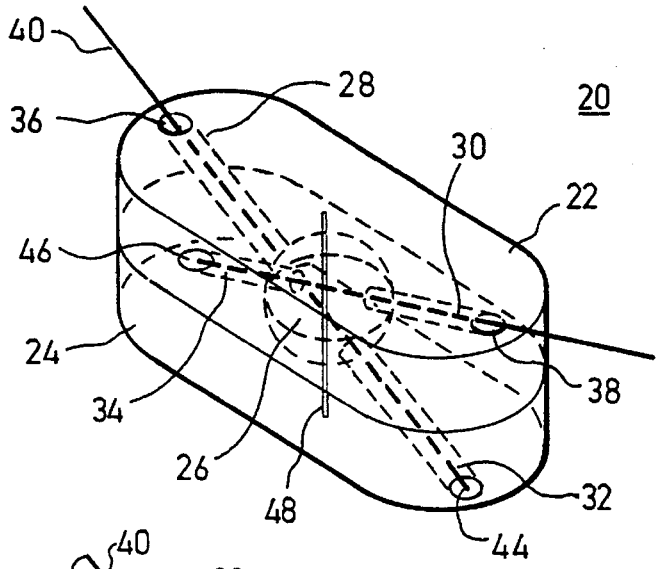
FIGS. 3*a*, 3*b* and 3*c* are perspective views of a wire connector capable of connecting a single wire pair forming an X shape according to one configuration of the present invention.
Figure 3B:
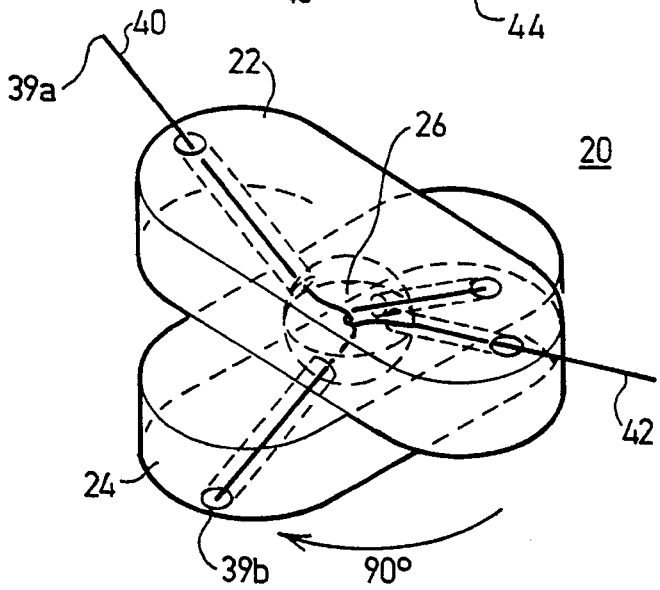
Figure 3C:
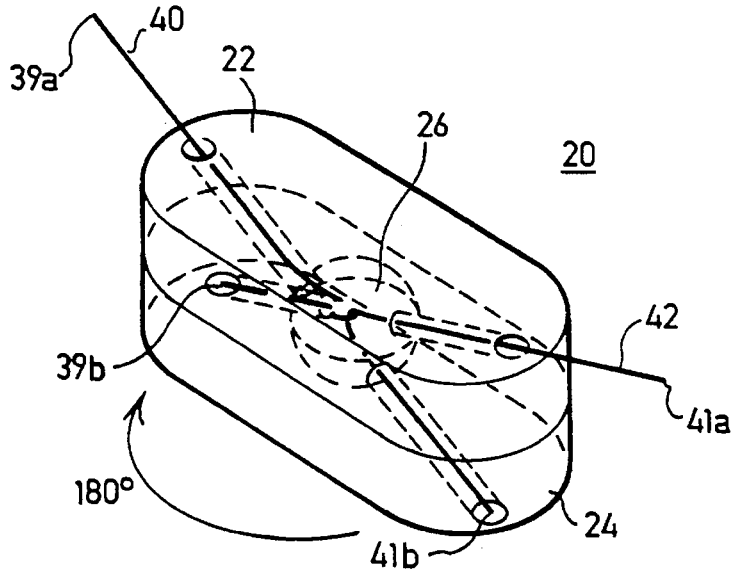

Referring now to the drawings, FIG. 3*a–c* illustrates a simple form of the wire connector of the present invention suitable for connecting two wires. The wire connector 20 in the configuration shown in FIG. 3*a–c* includes a first member 22 and a second member 24 defining a cavity 26 therebetween. The first member 22 including a first channel 28 and a second channel 30, whereas the second member is including a third channel 32 and a fourth channel 34. As shown in FIG. 3*a*, the first 28, second 30, third 32 and fourth 34 channels are in communication with cavity 26, forming a substantially X-shaped form. The first 28 and the third 32 channels are positioned substantially collinearly, the first 28 channel has a first additional opening 36, at the surface of member 22 for accommodating a first wire 40. It is understood to those with skills in the art that an alternative or an additional opening may be at the far end 44 of the third channel 32. The second 30 and the fourth 34 channels are also positioned substantially collinearly, the second 30 channel has a second additional opening 38, at the surface of member 22, for accommodating a second wire 42, steel it is understood to those with skills in the an that an alternative or an additional opening may be at the far end 46 of the fourth channel 34.

As shown in FIGS. 3*b–c*, rotating the second member 24 relative to the first member 22 as much as 90° (FIG. 3*b*), 180° (FIG. 3*c*) or more (not shown) substantially around the central point (i.e., the crossing point) of the X-shaped form which is substantially the center of cavity 26, winds the first 40 and the second 42 wires one around the other, thereby connecting them.

As demonstrated in FIG. 3*c*, when the first member 22 is rotated 180° or any odd multiplicity of 180°, relative to the second 24 member, each of the wires 40 and 42, have its both ends (39*a* and 39*b* for wire 40 and, 41*a* and 41*b*, for wire 42) positioned on the same side, therefore providing the connection between the wires 40 and 42 with a higher resistance to pulling in any vectorial direction. Nevertheless, as shown in FIG. 2, and described above, this positioning of the ends of two connected wires to the same side, is not characterizing the winding capabilities of the wire winding device of the prior art, shown in FIG. 1.

In a preferred configuration, members 22 and 24 are hingedly attached by a hinge 48 which, in the example shown in FIGS. 3*a*, is located substantially in the center of cavity 26 and enabling members 22 and 24 to rotate one relative to the other in the fashion described hereinabove. It is understood that many variations and options for hingedly attaching members 22 and 24 are available, such as, for example, members 22 and 24 may be hingedly attached by a circular hinge surrounding cavity 26 (not shown). However if hinge 48 is located substantially in the center of cavity 26, wires 40 and 42 will wind also around the hinge. This situation is preferred when the wire connector of the present invention is employed for connecting two electrical wires since it strengthens the connection and, in a case where hinge 48 is a good conductor, it will also ensure a connection characterized by low resistance to electrical current.

Nevertheless, it should be understood that, wire connector 20 may operate regardless of hinge 48, since wires 40 and 42 may serve as a hinge for hingedly attaching members 22 and 24 and for rotating them one relative to the other, as shown in FIGS. 3*b–c*.

Figure 4:
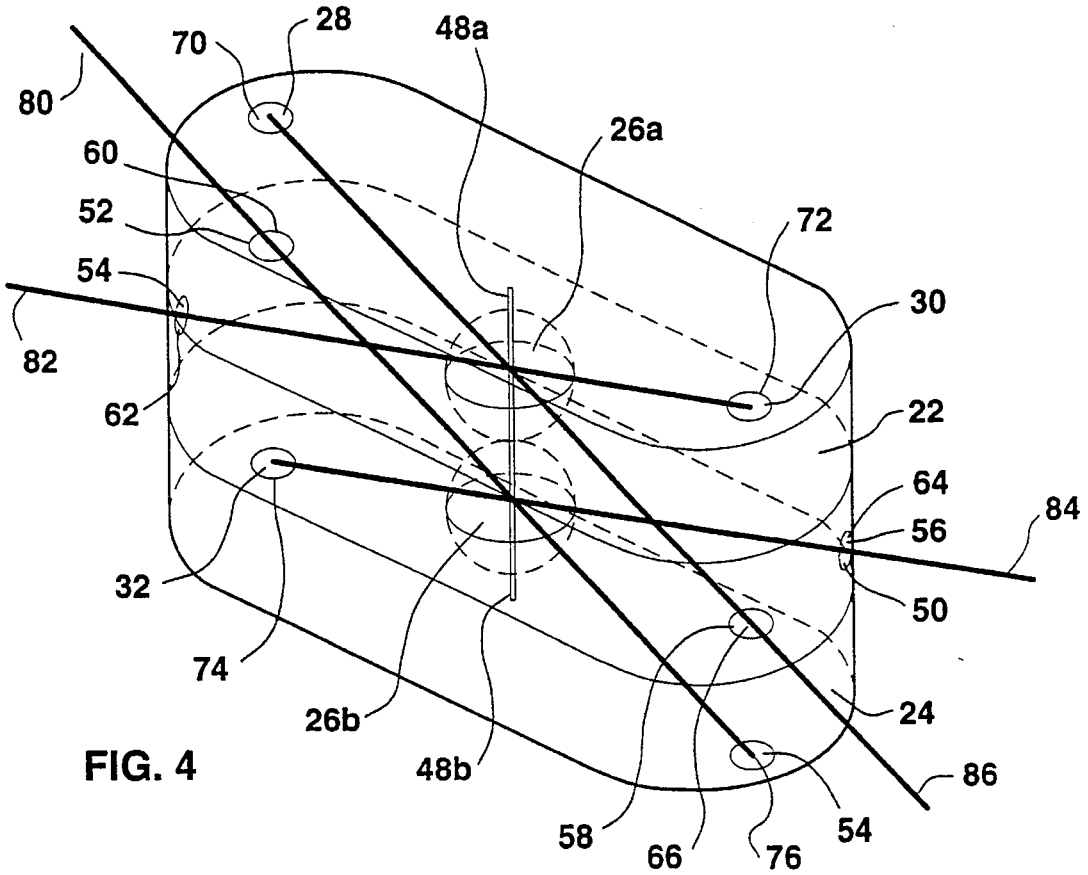
FIG. 4 is a perspective view of a wire connector capable of connecting two wire pairs each forming an X shape according to another configuration of the present invention.
Figure 5:
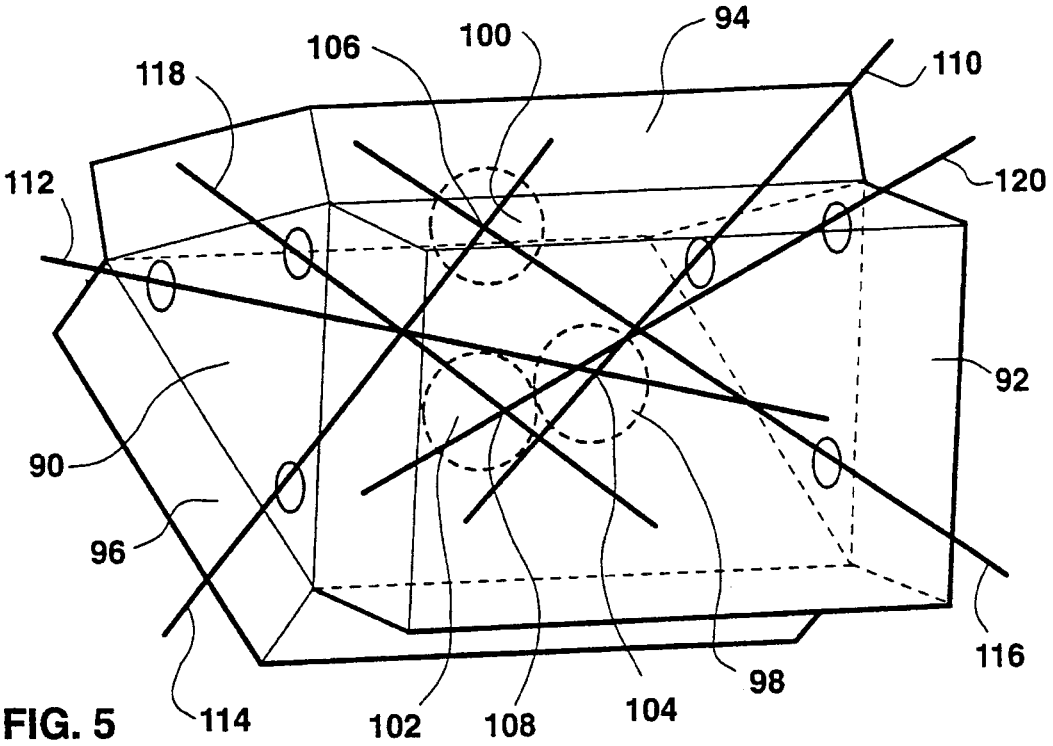
FIG. 5 is a perspective view of a wire connector capable of connecting three wire pairs each forming an X shape according to a different configuration of the present invention.

As shown in FIGS. 4 and 5, the wire connector according to the present invention may include additional members to enable the connection of any non-odd number of wires in pairs.

FIG. 4 illustrates a configuration enabling to connect two pairs of wires. According to this configuration a middle member 50 is rotatably connected on one of its sides to the first member 22 and on its other side to the second member 24. The wire connector in the configuration shown in FIG. 4, therefore, includes three me tubers defining two cavities 26*a* and 26*b* therebetween. The first member 22 includes a first channel 28 and a second channel 30, the second member includes a third channel 32 and a fourth channel 34, whereas the middle member 50 includes four additional channels 52, 54, 56 and 58. Channels 28, 30, 58 and 54 are connected to cavity 26*a* forming a substantially X-shaped form, whereas channels 32, 34, 52 and 56 are connected to cavity 26*b* forming an additional substantially X-shaped form. Channels 28 and 58, channels 30 and 54, channels 32 and 56 and channels 34 and 52 are positioned in substantially collinear channel pairs, each channel pair has one opening as follows: opening 60 at the far end of channel 52; opening 62 at the far end of channel 54; opening 64 at the far end of channel 56; and opening 66 at the far end of channel 58. Openings 60, 62, 64 and 66 are to enable the accommodation of wires 80, 82, 84 and 86 by the corresponding channel pairs.

It is, however, understood to those with skills in the art that alternative or additional openings may be at the far ends 70, 72, 74 and 76 of channels 28, 30, 32 and 34, respectively.

Rotating the first member 22 relative to the middle member 50 substantially around the central point of the X-shaped form which is substantially the center of cavity 26*a*, winds wires 82 and 86 one around the other, thereby connecting them, whereas rotating the second member 24 relative to the middle member 50 substantially around the central point of the additional X-shaped form which is substantially the center of cavity 26*b* winds wires 80 and 84 one around the other, thereby connecting them.

In a preferred configuration, members 22 and 24 are each hingedly attached by hinges 48*a* and 48*b*, located at cavities 26*a* and 26*b*, respectively, thereby enabling members 22 and 24 to rotate relative to member 50 in the fashion described hereinabove.

Nevertheless, it should be understood that, wire connector 20 may operate regardless of hinges 48*a* and/or 48*b*, since wires 86 and 82 and wires 80 and 84 may serve as hinges for hingedly attaching members 22 and 24, respectively, to member 50, and for rotating them one relative to the other.

As is apparent to those with skills in the art, adding additional middle members similar to member 50 in FIG. 4, in a modular manner, enables to connect any number of wire pairs in a similar fashion.

Is should be noted that wires that do not belong to a wire pair, are never in a direct contact with one another. This is a crucial feature of the wire connector of the present invention when it is employed for connecting electrical wires, to prevent the formation of a short circuit.

FIG. 5 illustrates a different configuration enabling to connect three pairs of wires. According to this configuration, a central member 90 having three sides, is rotatably connected on its first side to a first peripheral member 92, on its second side to a second peripheral member 94 and on its third side to a third peripheral member 96. Members 92, 94 and 96 are each independently rotatable relative to central member 90. The wire connector of the present invention, according to this configuration includes three groups of four channels, channels of each group of four channels are connected to three cavities 98, 100 and 102, defined by peripheral members 92, 94 and 96 and central member 90 therebetween, respectively, forming three substantially X-shaped forms with their centers 104, 106 and 108, respectively, located substantially in the center points of cavities 98, 100 and 102. These three X-shaped form structures enables the winding of three pairs of wires: 110–112, 114–116 and 118–120 simply by rotating each of the peripheral members 92, 94 and 96, respectively, relative to the central member 90.

The configuration of the wire connector of the present invention shown in FIG. 5, is suitable, for example, for connecting a tripled electrical wire including a plus wire, a minus wire and a ground wire to a second similar tripled wire.

It should be noted that replacing central member 90 by a central member including four sides and additional pair of channels and, adding an additional peripheral member also including an additional set of channels to the three peripheral members shown in FIG. 5, will enable to connect four pairs of wires. As a matter of fact, theoretically, there is no limit to the number of wire pairs that may be connected simply by constructing a central member with more sides and adding additional peripheral members, channels and cavities, as required.

Figure 6A:
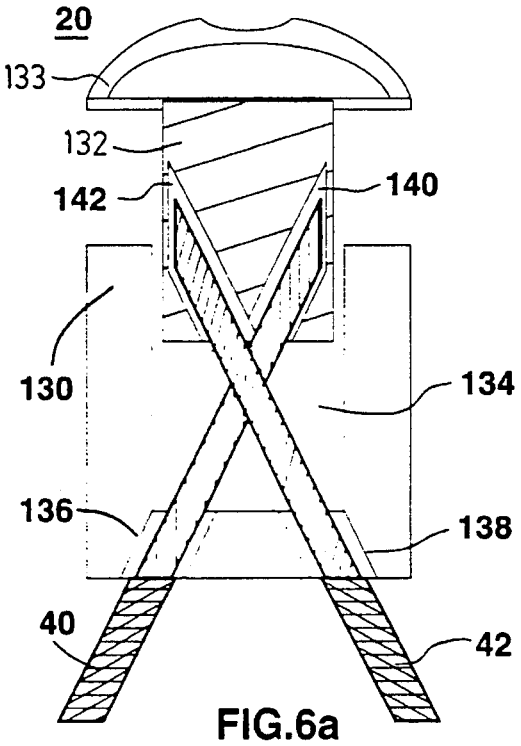
FIGS. 6*a*, 6*b*, and 6*c* are cross sections of a wire connector capable of connecting a wire pair forming an X shape according to a further configuration of the present invention in which further strengthening of the wound wires is by a pin or a screw.
Figure 6B:
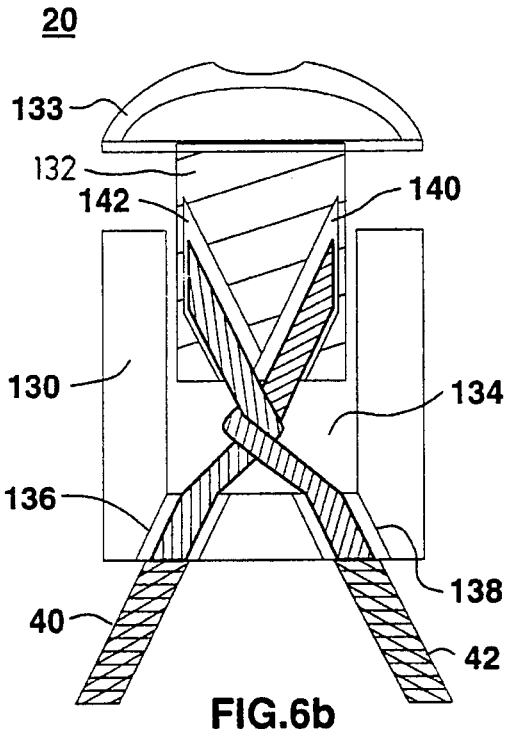
Figure 6C:
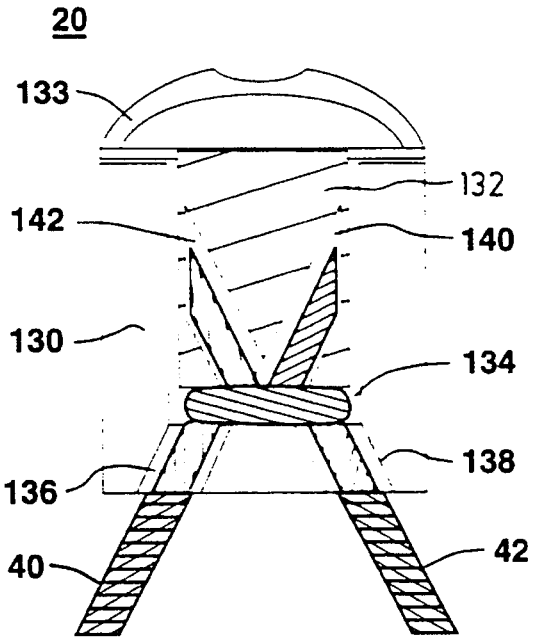

Another configurations of the wire connector of the present invention is presented in FIGS. 6 and 7. According to the configuration shown in FIGS. 6*a–c*, wire connector 20 includes a threaded housing 130 and a compatible threaded pin (i.e. a screw) 132, having a screw cap 133 (e.g., a winged screw), housing 130 and screw 132 defining a cavity 134 therebetween. Housing 130 includes a first channel 136 and a second channel 138, whereas screw 132 includes a third channel 140 and a fourth channel 142, the first 136, second 138, third 140 and fourth 142 channels being in communication with cavity 134. The first 136 and the third 140 channels being substantially collinear, at least one of the first 136 and the third 140 channels having a first additional opening 144 for accommodating a first wire 40. Similarly, the second 138 and the fourth 142 channels being substantially collinear, at least one of the second 138 and third 142 channels having a second additional opening 146 for accommodating second wire 42. In the configuration shown in FIG. 6*a–c*, the channels of the housing and of the screw form a substantially X-shaped form.

Figure 7A:
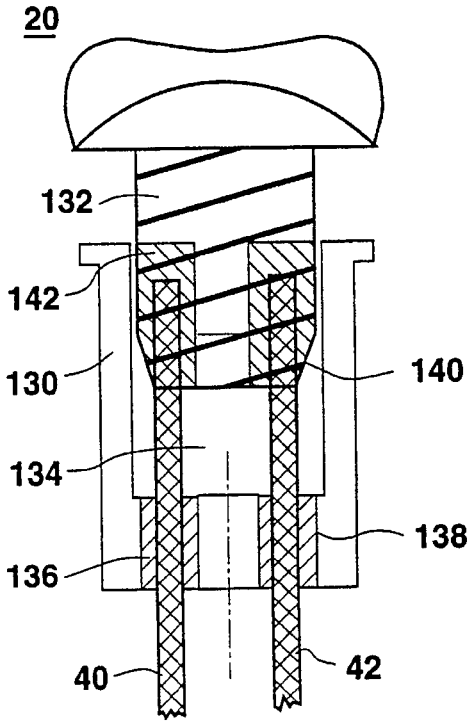
FIGS. 7*a*, 7*b*, and 7*c* are cross sections of a wire connector capable of connecting a parallel wire pair according to a further configuration of the present invention in which further strengthening of the wound wires is by a pin or a screw.
Figure 7B:
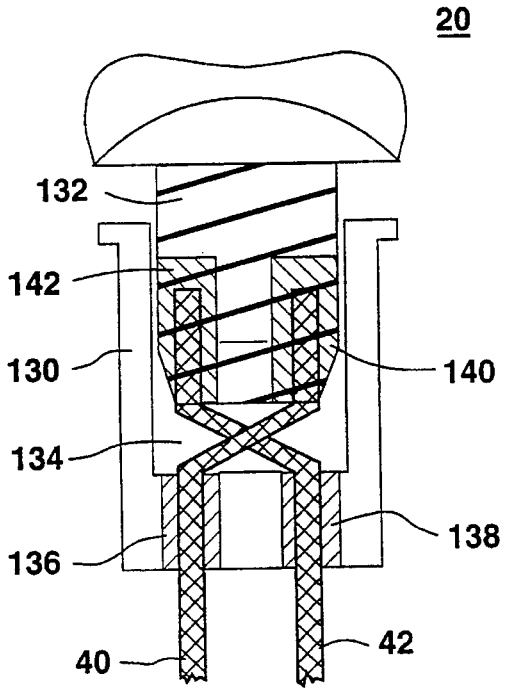
Figure 7C:
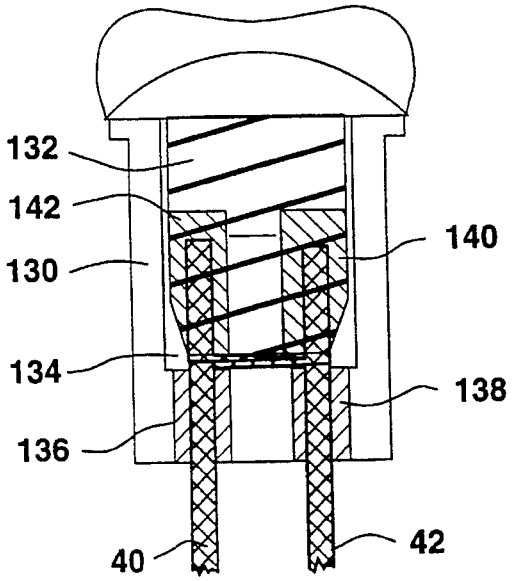

According to the configuration shown in FIGS. 7*a–c*, wire connector 20, has a very similar construction as compared with the configuration shown in FIGS. 6*a–c*. Nevertheless, according to the configuration shown in FIGS. 7*a–c*, channels 136, 138, 140 and 142 housing 130 and of screw 132 are in a parallel arrangement.

As shown in FIGS. 6*b* and 7*b*, screwing screw 132 into housing 130 bring about the winding wires 40 and 42 one around the other. Furthermore, as shown in FIGS. 6*c* and 7*c*, further screwing screw 132 into threaded housing 130, therefore, minimizing cavity 134, provides further strengthening of the connection between wires 40 and 42 since the connection is pressed between screw 132 and housing 130.

Since it might be difficult to insert the wires through the housing channels into the pin channels, it is presently preferred to provide the pin channels large enough to enable thus inserting the wires. It should be noted that according to any of the above mentioned configurations of the wire connector of the present invention, the cross section of any of the channels may acquire any suitable form such as a circle, square, half a circle etc.

It is understood to those with skills in the an that employing a threaded housing and a screw is aimed at strengthening the connection between the wires by pressing the connection between the screw and the housing. Nevertheless, this effect could be similarly achieved by providing a non-threaded housing made of a flexible material, which non-threaded housing acts as a biasing device to keep the screw within it. In this case a simple capped (e.g., winged) unthreaded screw (e.g., a winged pin) may replace the screw and, a simple locking device which may acquire various forms may lock the unthreaded screw to the housing.

It is further understood that any number of units of the wire connector as shown in FIGS. 6 and 7, may be modularity connected to one another to enable winding of more than one pair of wires.

It should be noted that according to all of the configurations of the wire connector of the present invention described hereinabove, wires that do not belong to a wire pair, are never in a direct contact with one another. This is a crucial feature of the wire connector of the present invention when it is employed for connecting electrical wires, to prevent the formation of a short circuit.

If the wire connector of the present invention is to connect electrical wire pairs, the material of which the wire connector is made of is selected to be electrical current insulating material, such as, but not limited to plastic, rubber, glass, wood, synthetic and natural polymers and combinations thereof, whereas if the wire connector is to connect other types of wires it may be made of any suitable material.

Rotatably attaching members of the wire connector of the present invention according to the configurations described in FIGS. 3–5 may be accomplished by a simple hinge, as exemplified in FIGS. 3*a* and 4, located substantially in the center of the cavity formed between members of the wire connector. In this case the wires will wind also around the simple hinge. It is, however, understood that other variations of hingedly attaching members of the wire connector of the present invention are available. These include, for example, a circular hinge surrounding the cavity formed between the attached members. However, as is apparent to those with skills in the art, that the wires themselves may serve as a rotation center or a hinge to rotate any such members.

However, it is understood to those with skills in the art, that the wire connector of the present invention according to all of its configurations presented hereinabove, may include more than two channels in each of its members, the additional channels communicating with the cavity, therefore, enabling to connect more than two wires by winding. This configuration of the wire connector of the present invention is useful, for example, in connecting a multiple number of electrical ground wires to a main ground wire, itself connected to the ground.

The cavities defined between members of the wire connector of the present invention according to any of its configurations described hereinabove are preferably selected to be large enough to accommodate winding of the wire pairs. It should be noted that the X-shaped channel structures of the wire connector of the present invention are preferably not intersecting directly, rather, their volumes are joined by the cavities formed between members of the wire connector. This construction of the wire connector of the present invention facilitates inserting the wire pairs into the channels. Nevertheless, proper channel width selection with respect to the thickness of the wires to be connected may allow the construction of directly intersecting channels and in some cases will diminish the need for cavities to connect the channels all together. In this case the cavities are formed by the intersecting channels themselves. Nevertheless, independent cavities are presently preferred and may be a contribution of any one of two members rotatable one relative to the other, or both (the later is exemplified in FIGS. 3–5).

Figure 8:
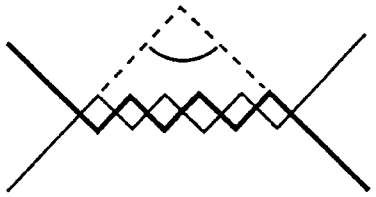
FIG. 8 is a schematic depiction of an X shaped connection formed between wires connected by the wire connector of the present invention.

According to the configurations of the wire connector of the present invention shown in FIGS. 3–6, and in contradistinction to the prior art device for wires winding as described above and shown in FIG. 2, the connected wires are arranged in an angle greater than 0° and smaller than 80°(X-shaped), typically, as shown in FIG. 8, in the range of 60°–120°, thereby strengthening the physical resistance of the connection between the wires to unwind by a pull of any of the wires in any vectorial direction. However, the prior art device for wires winding is less resistant to a physical pull since the wires are located at substantially 0° or 180°.

Figure 1A:
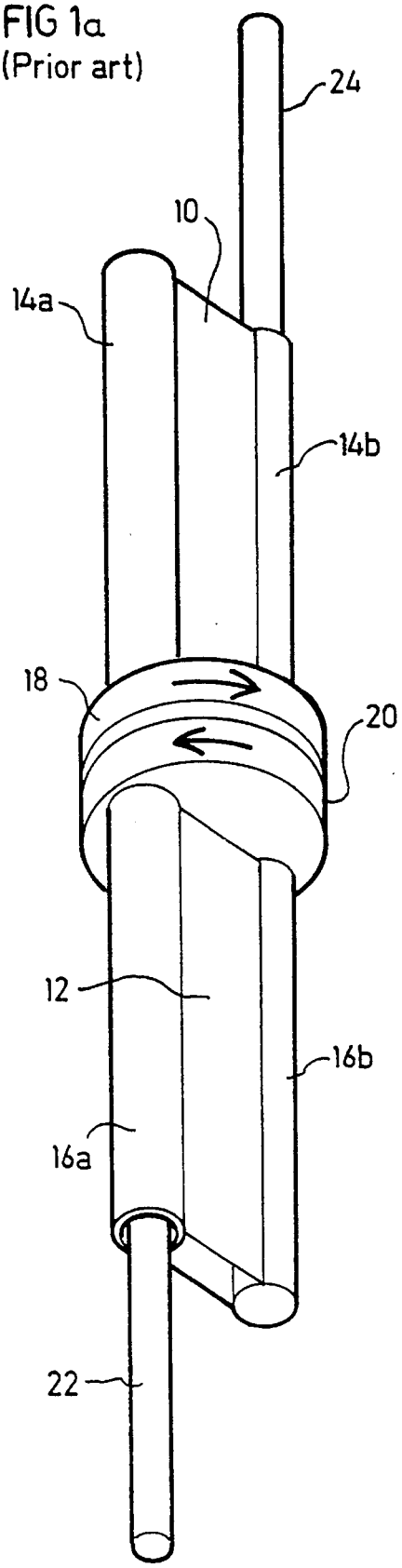
FIG 1a (Prior art)
FIGS. 1*a* and 1*b* are perspective views of a prior art device for winding two wires.
Figure 1B:
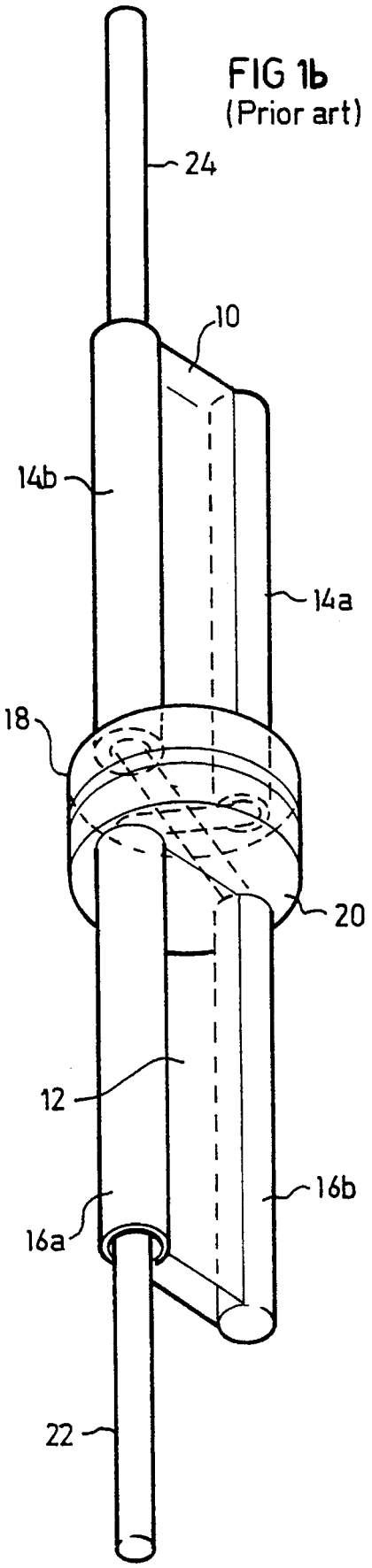
FIG 1b (Prior art)
Figure 2:
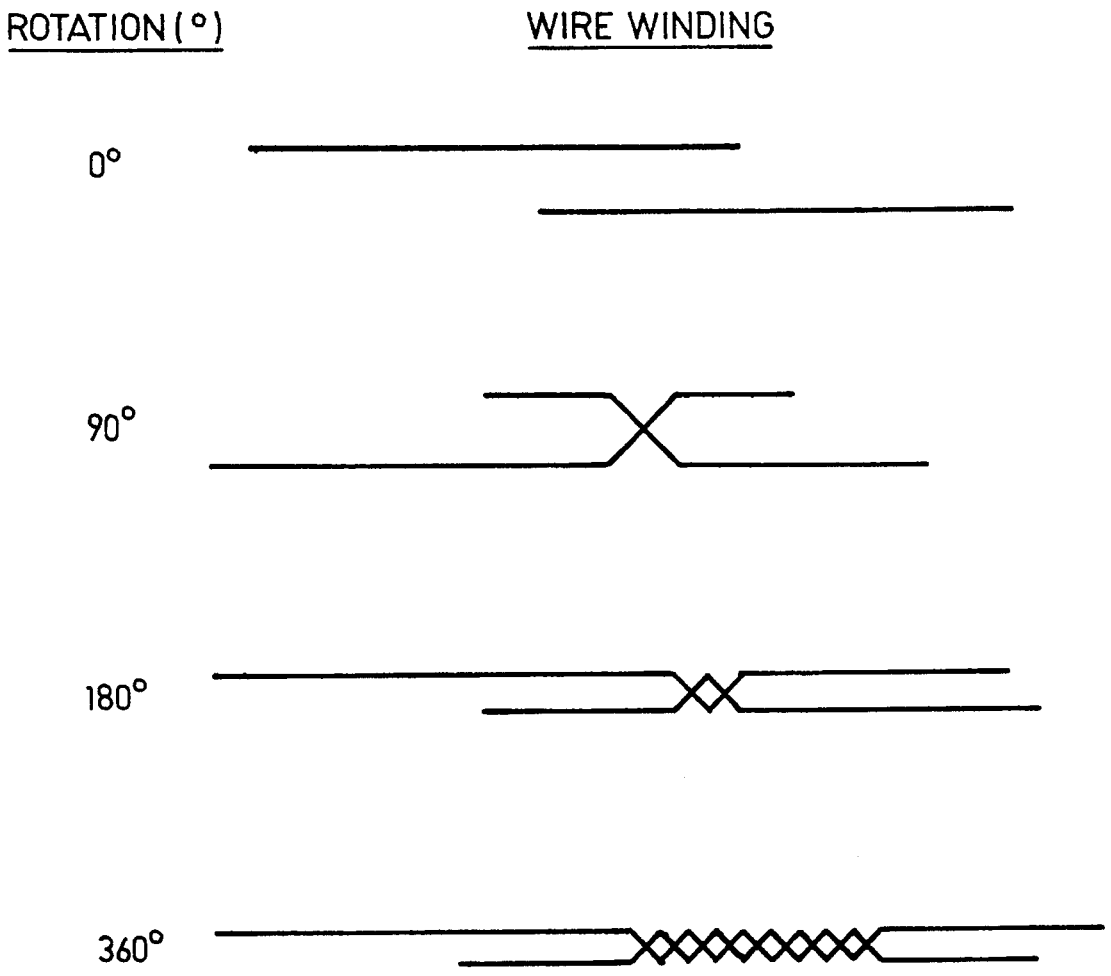
FIG.2 (Prior art)
FIG. 2 is a schematic depiction of the connection formed between wires connected by the prior art device for winding two wires.

Furthermore, as shown in FIGS. 1,2 and 3*c*, when wires of a wire pair are rotated 180° or any odd multiplicity of 180°, relative to one another, using the wire connector of the present invention, the wires form an X-like shape, each of the wires has its both ends positioned to the same side, therefore providing the connection between the wires a higher resistance to pulling in any vectorial direction. Nevertheless, as shown in FIG. 2, this positioning of the ends of two connected wires to the same side, is not characterizing the winding capabilities of the wire winding device of the prior art.

According to the configurations of the wire connector of the present invention shown in FIGS. 6 and 7, further strengthening of the connection between the connected wires may be achieved by one of the members being a threaded housing while the other being a compatible threaded pin (i.e., a screw) and by screwing the pin all the way into the housing. As presented in FIG. 7, in this case the channels within the members may be arranged in a parallel arrangement, as opposed to X-shaped arrangement.

In addition, the wire connector of the present invention is readily accustomed to connect any number of wire pairs, either by adding members according to the configuration shown in FIG. 4 or, by connecting as many as required peripheral members around a suitable central member according to the configuration shown in FIG. 5 or, by connecting together units of wire connectors of the types shown in FIGS. 6 and 7. Yet, the prior art device for wire winding is not readily accustomed for connecting more than two wires.

While the invention has been described with respect to a limited number of embodiments, it will be appreciated that many variations, modifications and other applications of the invention may be made.

What is claimed is:

1. A wire connector permitting a secured, strong and safe winding of a wire pair including a first and a second wire, comprising a first member and a second member defining a cavity therebetween, said first member including a first channel and a second channel, said second member including a third channel and a fourth channel, said first, second, third and fourth channels being in communication with said cavity, said first and second members having at least one relative orientation in which said channels form a substantially X-shaped form, said X-shaped form including a substantial central point, said first and said third channels being substantially collinear, at least one of said first and said third channels having a first opening for inserting the first wire, said second and said fourth channels being substantially collinear, at least one of said second and fourth channels having a second opening for inserting the second wire, said first member being rotatable relative to said second member substantially around said central point.

2. A wire connector as in claim 1, wherein one of said first, second, third and fourth channels has a third opening.

3. A wire connector as in claim 2, wherein one of said first, second, third and fourth channels has a fourth opening.

4. A wire connector as in claim 1, further comprising a hinge, said hinge connecting said first and said second members substantially at said central point for rotating said first member relative to said second member substantially around said central point.

5. A wire connector as in claim 4, wherein said hinge is a simple hinge, said simple hinge crossing said cavity.

6. A wire connector as in claim 4, wherein said hinge is a circular hinge, said circular hinge surrounding said cavity.

7. A wire connector as in claim 1, wherein said first and said third channels form a first continuous channel and said second and said fourth channels form a second continuous channel, said first and second continuous channels intersecting to form said cavity.

8. A wire connector as in claim 1, wherein said first and second members are made of an electrical current insulating material.

9. A wire connector as in claim 8, wherein said electrical current insulating material is selected from the group consisting of plastic, rubber, glass, wood, synthetic polymers, natural polymers and combinations of plastic, rubber, glass wood, synthetic polymers and natural polymers.

10. A wire connector as in claim 1, wherein said cavity formed solely in one of said first and second members.

11. A wire connector as in claim 1, wherein said cavity formed in both said first and said second members.

12. A wire connector as in claim 1, wherein said wires are electrical wires.

13. A wire connector as in claim 1, further comprising at least one additional member for connecting at least one additional wire pair said at least one additional member being rotatably connected to any of said first and second members.

14. A wire connector as in claim 13, wherein one of said first, second, third and fourth channels has a third opening.

15. A wire connector as in claim 14, wherein one of said first, second, third and fourth channels has a fourth opening.

16. A wire connector as in claim 13, further comprising a hinge, said hinge connecting said first and said second members substantially at said central point for rotating said first member relative to said second member substantially around said central point.

17. A wire connector as in claim 1, wherein each of said members includes at least one additional channel for accommodating one additional wire, said at least one additional channel communicating with said cavity, the wire connector enabling winding of said one additional wire with said first and second wires.

18. A wire connector permitting a secured, strong and safe winding of a wire pair including a first and a second wires comprising a housing and a compatible pin defining a cavity therebetween, said housing including a first channel and a second channel, said pin including a third channel and a fourth channel, said first, second, third and fourth channels being in communication with said cavity, said housing and said compatible pin have at least one relative orientation in which said channels form a substantially X-shaped form, said first and said third channels being substantially collinear, at least one of said first and said third channels having a first opening for inserting the first wire, and, said second and said fourth channels being substantially collinear, at least one of said second and fourth channels having a second opening for inserting the second wire.

19. A wire connector as in claim 18, wherein said pin is threaded and said housing is compatibly threaded.

20. A wire connector as in claim 18, wherein each of said housing and pin includes at least one additional channel for accommodating one additional wire, said at least one additional channel communicating with said cavity, the wire connector enabling winding of said one additional wire with the first and second wires.

* * * * *